United States Patent [19]

Yamada et al.

[11] 4,342,547

[45] Aug. 3, 1982

[54] ROTARY VANE COMPRESSOR WITH VALVE CONTROL OF OIL TO BIAS THE VANES

[75] Inventors: Kaichi Yamada, Kusatsu; Yoshiyuki Morikawa, Otsu; Katuharu Fujio, Shiga; Koichi Yoshihiro, Otsu; Toshio Matsuda; Tatsuhisa Taguchi, both of Kusatsu, all of Japan

[73] Assignee: Matsushita Electric Industrial Co., Ltd., Kadoma, Japan

[21] Appl. No.: 136,392

[22] Filed: Apr. 1, 1980

[30] Foreign Application Priority Data

| | | | |
|---|---|---|---|
| Apr. 4, 1979 | [JP] | Japan | 54-40574 |
| Apr. 5, 1979 | [JP] | Japan | 54-41373 |
| Apr. 5, 1979 | [JP] | Japan | 54-41374 |
| Apr. 5, 1979 | [JP] | Japan | 54-41375 |
| Apr. 5, 1979 | [JP] | Japan | 54-41376 |

[51] Int. Cl.[3] ..... F04C 29/02

[52] U.S. Cl. ..... 418/84; 418/87; 418/93; 418/99; 418/DIG. 1

[58] Field of Search ..... 418/84, 87, 93, 97–100, 418/DIG. 1

[56] References Cited

U.S. PATENT DOCUMENTS

| | | | |
|---|---|---|---|
| 2,654,532 | 10/1953 | Nichols | 418/84 |
| 3,243,103 | 3/1966 | Bellmer | 418/87 |
| 3,936,238 | 2/1976 | Wycliffe | 418/97 |

FOREIGN PATENT DOCUMENTS

| | | | |
|---|---|---|---|
| 2708527 | 9/1977 | Fed. Rep. of Germany | 418/87 |

*Primary Examiner*—John J. Vrablik

*Attorney, Agent, or Firm*—Wenderoth, Lind & Ponack

[57] ABSTRACT

An improved vane type rotary compressor provided with a control mechanism of a lubricating oil supply passage by which the lubricating oil supply passage is arranged to be opened during operation of the compressor, and to be closed during shut-down of the compressor for obtaining a sufficient amount of lubricating oil supply during operation and also for preventing reverse rotation during shut-down of the compressor.

3 Claims, 6 Drawing Figures

ROTARY VANE COMPRESSOR WITH VALVE CONTROL OF OIL TO BIAS THE VANES

BACKGROUND OF THE INVENTION

The present invention generally relates to a compressor and more particularly, to a vane type rotary compressor, for example, for use in an air conditioning apparatus for motor vehicles and the like.

Conventionally, in a vane type rotary compressor, there has been employed means which depresses or urges the vanes so as to bring them into pressure contact with a cylinder wall by feeding pressurized lubricating oil at a high pressure generated at a discharge side of the compressor into bottom portions of vane grooves, and which means simultaneously lubricates the end faces of the rotor, the sliding faces between the vanes and rotor, etc.

The known arrangement as described above, however, has such disadvantages that, upon shutting down of the compressor, part of the lubricating oil is caused to continue to flow towards the bottom portions of the vane grooves by the high pressure remaining at the discharge side of the compressor, and that excessive lubricating oil tends to flow into the cylinder through the gap between the end faces of the rotor and side plate constituting the side wall of the cylinder or the clearance between the vanes and the vane grooves for further advancing towards the low pressure side in the cylinder. Accordingly, the rotor is subjected to reverse rotation by the flow of the lubricating oil as described above, and the leaking oil is also directed towards the suction pipe, and thus, abnormal pressure is built up in the cylinder due to compression of the oil during restarting of the compressor, resulting in serious problems such as breakage of the vanes and rotor or deformation of the discharge valve, etc.

In order to overcome the disadvantages as described above, there has heretofore been proposed one system in which, by directing attention to the pressure difference before and after the discharge valve which is particularly conspicuous at the starting and stopping of the compressor, there is provided, in a lubricating oil passage, an on-off valve actuated by the above pressure difference, and arranged to open the lubricating oil passage during operation of the compressor and to close said lubricating oil passage upon shutting down thereof. Although the above prior art arrangement has a certain beneficial effect, it has been known that, in the vane type rotary compressors, the state of the refrigerant gas to be discharged upon one rotation of the rotor is such that a pressure difference is built up in the gas within the compression chamber before and after the vanes pass the outlet for the gas pressure in the compression chamber which causes development of pulsations equivalent to the number of vanes, thus resulting in momentary inversion of the pressure difference before and after the discharge valve. Accordingly, the on-off valve in the lubricating oil passage is caused to vibrate at high speed so as to shut off the oil passage in some cases, giving rise to various problems such as a "jumping" phenomenon of the vanes due to insufficient supply of the lubricating oil towards the bottom portions of the vane grooves, generation of noises, etc.

SUMMARY OF THE INVENTION

Accordingly, an essential object of the present invention is to provide an improved vane type rotary compressor in which entry of lubricating oil into the cylinder during shutting down of the compressor, and compression of the oil during re-starting of the compressor are prevented, while continuous supply of the lubricating oil towards the bottom portions of the vane grooves is achieved during operation for improving the follow-up property of the vanes with respect to the inner wall of the cylinder, with a consequent improvement of the compression efficiency.

Another important object of the present invention is to provide an improved vane type rotary compressor of the above described type in which a plunger valve mechanism is employed to stabilize the amount of the lubricating oil supplied to the vane grooves during rotation of the compressor for preventing abnormal abrasion of the vanes and cylinder due to the "jumping" phenomenon of the vanes.

A further object of the present invention is to provide an improved vane type rotary compressor of the above described type in which, by forming a narrow passage having a small cross sectional area at part of a passage for introducing compressed gas under pressure into a valve mechanism, the influence of pulsations on the valve mechanism arising from passing of the vanes is relieved so as to stabilize the functioning of the valve mechanism.

A still further object of the present invention is to provide an improved vane type rotary compressor of the above described type in which, through employment of a seal ring in the valve mechanism, pressure leakage from the valve mechanism is prevented so as to further stabilize the functioning of the valve mechanism and provide a stable supply of the lubricating oil.

Another object of the present invention is to provide an improved vane type rotary compressor of the above described type in which a relief or escape groove is defined between a top portion of the cylinder where the rotor most closely approaches the cylindrical inner wall of the cylinder and a refrigerant discharge outlet so as to prevent the discharge refrigerant gas from being confined, and also to eliminate generation of vane noises and abnormal abrasions of the sliding faces of the vanes and cylinder resulting therefrom.

A further object of the present invention is to provide an improved vane type rotary compressor of the above described type which is simple in construction and accurate in functioning, and can be readily manufactured on a large scale at low cost.

In accomplishing these and other objects according to one preferred embodiment of the present invention, there is provided an improved vane type rotary compressor which comprises a main body provided with at least a cylinder and a rotor rotatably disposed in the cylinder to constitute a compression chamber for refrigerant, vane members provided in the rotor so as to selectively project from and retract into the rotor and defining the compression chamber together with the rotor, a lubricating oil tank provided in the main body and storing therein lubricating oil, a lubricating oil supply passage for supplying lubricating oil at the discharge pressure of the cylinder to the vane members so as to effect the selective projection from and retraction into the rotor, of the vane members, a pressure passage open, at its one end, into the compression chamber and at its other end, to the lubrication tank, and a valve mechanism provided in the pressure passage for selective opening and closing of the lubricating oil passage in response to the pressure difference between the pressure of compressed gas in the compression chamber and pressure within the main body acting on the lubricating oil.

By the arrangement according to the present invention as described above, an efficient vane type rotary compressor with a high compression efficiency is provided which substantially eliminates the disadvantages inherent in the conventional rotary compressors of this kind.

BRIEF DESCRIPTION OF THE DRAWINGS

These and other objects and features of the present invention will become apparent from the following description of an embodiment thereof and with reference to the accompanying drawings in which.

Before the description of the present invention proceeds, it is to be noted that like parts are designated by like reference numerals throughout the several views of the accompanying drawings.

DETAILED DESCRIPTION OF THE INVENTION

Figure 1:
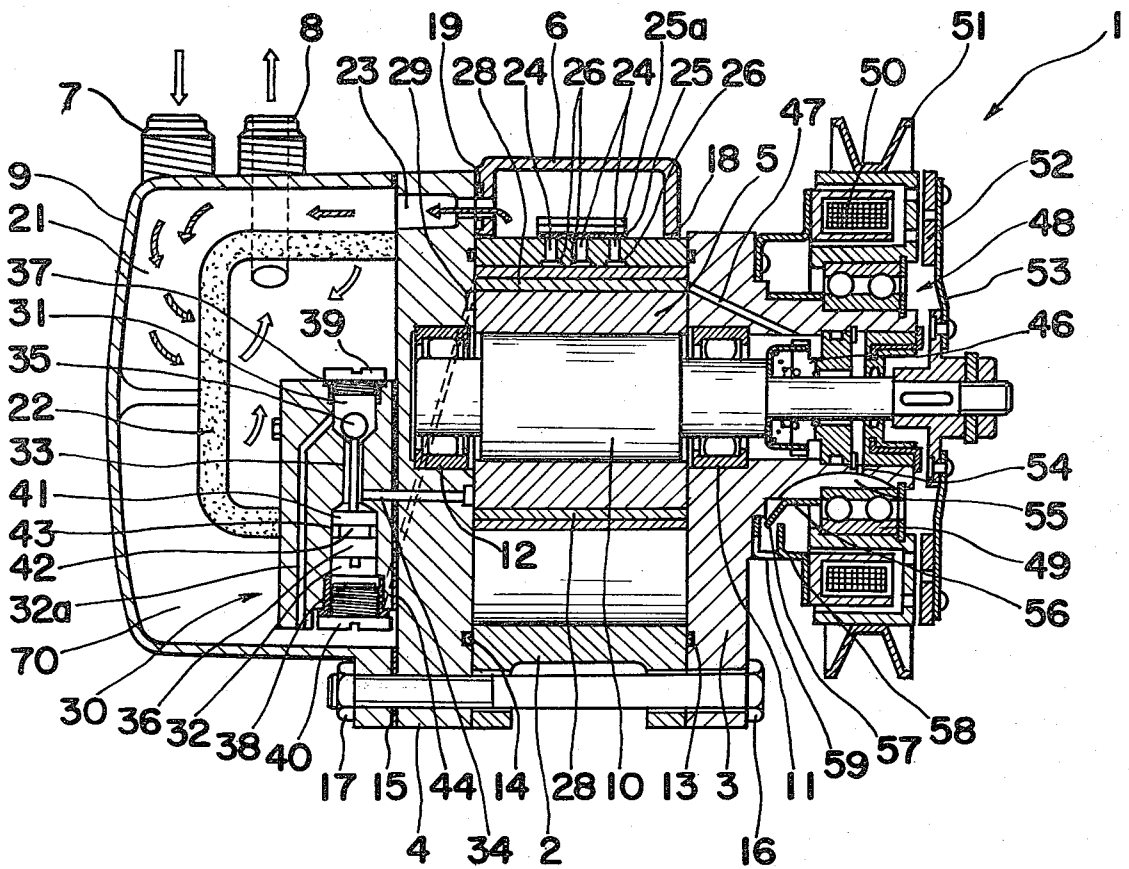
FIG. 1 is a longitudinal sectional view of a vane type rotary compressor according to one preferred embodiment of the present invention.
Figure 2:
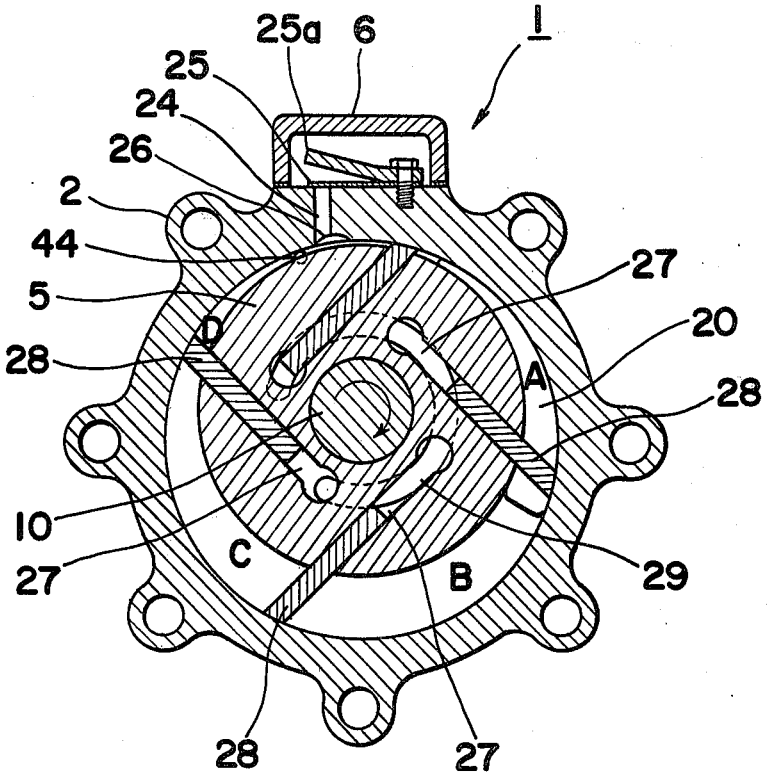
FIG. 2 is a cross sectional view of the rotary compressor of FIG. 1.

Referring now to the drawings, there is shown in FIGS. 1 and 2 a rotary compressor 1 according to one preferred embodiment of the present invention. The compressor 1 generally includes a cylinder 2 having a cylindrical space defined therein, end plates 3 and 4 closing corresponding openings at opposite ends of the cylinder 2, a rotor 5 rotatably provided within said cylinder 2, a discharge cover 6 provided at one part of the outer surface of the cylinder 2, a casing 9 secured to the end plate 4, and a suction pipe 7 and a discharge pipe 8 for refrigerent provided on the casing 9 and extending outwardly a certain extent from one side of said casing 9. The rotor 5 is coupled to a shaft 10 for rotation together with the shaft 10 as one unit. In addition, the shaft 10 is rotatably supported by bearings 11 and 12 provided, respectively, on the end plates 3 and 4. The cylinder 2, end plates 3 and 4, and casing 9 are rigidly combined, through seal rings 13, 14 and a gasket 15, into one unit by bolts 16 and nuts 17. In addition, the discharge cover 6 is connected, through a gasket 18 and a seal ring 19, with the cylinder 2 by a means such as bolts or the like. The interior of the casing 9 is broadly divided into two layers or chambers, and the suction pipe 7 is in communication with an inlet port 20 formed in the cylinder 2 through one of the two chambers, while the other chamber 21 thereof is in communication with the discharge pipe 8 through an oil separator 22 the discharge side of which includes a filter or the like. On the other hand, the fluid inlet side of chamber 21 is in communication with the interior of the discharge cover 6 through communication holes 23 which are formed respectively in the end plate 4 and the discharge cover 6. Discharge ports 24 formed in the cylinder 2 are each provided with a discharge valve 25 and a discharge valve limit stop **25*a* to place the interior of the discharge cover 6 in communication with the high pressure space within the cylinder 2. Relief grooves or escape grooves 26 provided in the inner face of cylinder 2 between the discharge ports 24 and a top dead center position where the rotor 5 is closest to the cylinder inner wall and are in communication with the discharge ports 24. The rotor 5 is formed therein with a plurality of vane grooves 27 in each of which a vane 28 is slidably accommodated for selective projection from or retraction into the rotor 5 so as to be normally in contact with the inner wall of the cylinder 2 at its forward end as shown in FIG. 2. In the end plate 4, on the rotational locus of the lowermost portions of the vane grooves 27, there is an oil groove 29 which is in the shape of part of an annulus and which is normally in communication with the vane grooves 27. A valve mechanism 30 provided integrally with the end plate 4 includes a valve chest 31, a plunger chest 32 in communication with the valve chest 31, a first oil passage 32*a* connecting the valve chest 31 with the interior of the casing 9, a second oil passage 33 connecting the valve chest 31 with the plunger chest 32, a third oil passage 34 connecting the second oil passage 33 with the oil groove 29, a spherical valve 35 disposed inside the valve chest 31 so as to seat on a valve seat around the end of second oil passage 33 and a plunger 36 the distal end of which is selectively projectable, or retractable with respct to the valve chest 31 to cause the spherical valve 35 to be unseated or to allow it to seat. A screw thread is formed in each of the inner faces of the open ends of the valve chest 31 and the plunger chest 32, and they are closed by packings 37 and 38, by bolts 39 and 40. The shell 41 of the plunger 36 has in its outer periphery, a groove 42, in which an annular seal material 43 is accommodated the outer surface of said seal material 43 contacting the plunger wall to provide a proper resistance against the movement of the plunger 36. A pressure passage 44 formed in the end plate 4 has its one end open immediately before the top dead center position in the high-pressure space inside the cylinder 2 and the other end thereof open into the screw thread in the plunger chest 32. The pressure passage 44 is in communication with the plunger chest 32 through a spiral narrow passage 45 formed by the above screw thread and the mating screw thread on the bolt 40. A shaft sealing arrangement 46 disposed on the end plate 3 is located on the driving end of the shaft 10 to prevent lubricating oil from leaking out of the end plate 3. Since the above shaft sealing arrangement 46 may be a known construction, a detailed description thereof is omitted here for brevity. A fourth oil passage 47 formed in the end plate 3 has its one end open to the end face of the rotor 5 and the other end thereof open at the side of the bearing 11 to feed, towards the side of the bearing 11, part of the oil leaking into a narrow gap between the end face of the rotor 5 and the end plate 3**.

An electromagnetic clutch 48 provided on the driving end of the shaft 10, includes a bearing 49 and an electromagnetic coil 50 secured to the side of the end plate 3, a pulley 51 arranged to be rotatable with respect to the end plate 3 through the bearing 49, and an attraction plate 52 mounted on the shaft 10. More specifically, in the above clutch 48, the attraction plate 52 is attracted towards the electromagnetic coil 50, against the resiliency of an elastic plate 53, upon energization of the electromagnetic coil 50 so as to be attracted onto the face of the pulley 51, whereby the pulley 51 is attached to the shaft 10. An oil discharge passage 54 formed outside the shaft sealing arrangement 46 in the end plate 3 is connected with a groove 55 formed by cutting out part of the end plate 3. A guide plate 56 which forms the bottom portion of the cut groove 55 is downwardly inclined at its forward edge to form an open passage 57 with respect to the end plate 3. The inclined edge of the guide plate 56 faces an opening 59 provided at one portion of a support plate 58 of the electromagnetic coil 50, whereby the open passage 57 is connected with the outside.

Figure 4:
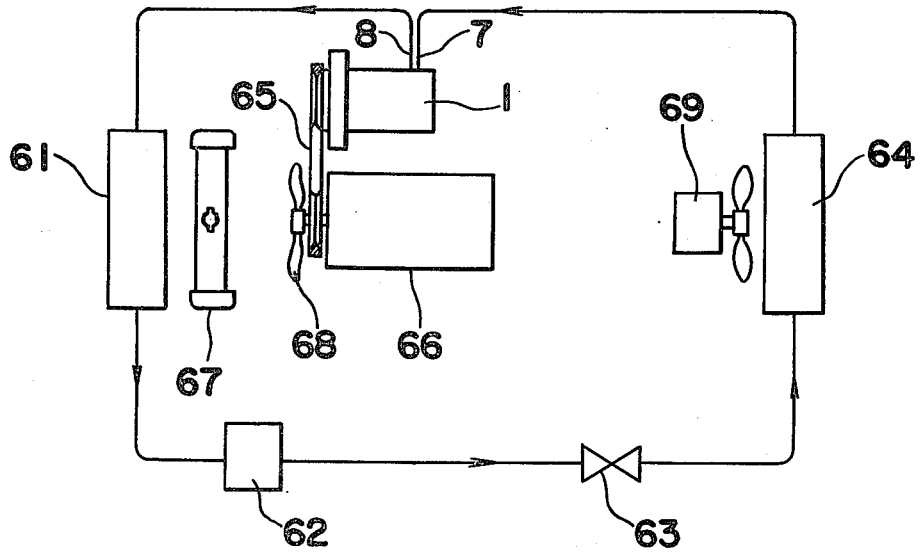
FIG. 4 is a diagram for explaining the refrigeration system using the rotary compressor of FIG. 1.

The rotary compressor having the construction as described hereinabove is coupled in a series circuit including a condenser 61, a liquid receiver 62, a decompression device 63 and an evaporator 64 through the discharge pipe 8 to the suction pipe 7, as shown in FIG. 4, to constitute a known refrigerating system. The pulley 51 provided on the compressor body 1 is coupled, through a belt 65, to an engine 66 of a motor vehicle to drive the compressor body 1 from the engine 66, through the electromagnetic clutch 48. Other components shown in FIG. 4 such as a radiator 67, a fan 68 for cooling the condenser 61 and the radiator 67, a fan unit 69 disposed on one side of the evaporator 64, etc. may be of known constructions and therefore, detailed description thereof is omitted here for brevity.

The operation of the rotary compressor will be described hereinbelow. It is to be noted here that since the rotary compressor is to be actuated when an air cooling operation is effected, and for maintaining proper air-cooling temperatures, known techniques such as intermittent operation of the compressor in the above system by control of energization of the electromagnetic coil 50, control of the fan unit 69, or control by both may be employed, a detailed description thereof is also omitted here for brevity.

In the first place, when the rotation of the pulley 51 is transmitted to the shaft 10 through the electromagnetic clutch 48, the shaft 10 is rotated in the direction of the arrow in FIG. 2 thereby to rotate the rotor 5. Accordingly, inside the cylinder 2, processes such as suction →compression→discharge sequentially take place by fluctuation of the volumes in a plurality of spaces A, B, C and D defined by the rotor 5 and the vanes 28 as shown in FIG. 2. Compressed refrigerant discharged by the compressor 1 performs a predetermined cooling operation as it flows through the known refrigeration system as shown in FIG. 4 in the direction of arrows.

The condition inside the compressor 1 will be described hereinafter with reference to FIG. 1 and FIG. 2.

Gaseous refrigerant coming from the discharge ports 24 is discharged into a discharge cover 6 and is further led into the casing 9 through the communication hole 23. The refrigerant discharged into the casing 9 has part of the lubricating oil removed by the oil separator 22, and flows towards the discharge pipe 8. The removed lubricating oil stays in the bottom portion of the casing 9 which serves as an oil tank in which is formed a pool 70 of the lubrication oil.

On the other hand, in the valve mechanism 30, the pressure passage 44 is open to the high-pressure space D defined in the cylinder 2. Thus, the pressure in the plunger chest 32 becomes higher than the pressure in the casing 9 and pushes the plunger 36 up, and thus keeps the spherical valve 35 open. The plunger 36 is not subjected to vertical motion within the plunger chest 32 by the pulsating pressure changes in space D, since the narrow passage 45 constituting an extension of the pressure passage 44 relieves the pulsating pressure caused as each vane 28 passes the open end of the pressure passage 44. Accordingly, the spherical valve 35 is kept open in a substantially stable condition. As a result, the lubricating oil pool 70 is pressurized at the discharge refrigerant pressure to cause the lubricating oil to flow from the first oil passage **32*a* into the valve chest 31, and further, into the second oil passage 33, the third oil passage 34 and the oil groove 29. The lubricating oil flowing into the oil groove 29 lubricates the rotor 5 and end plate 4 and simultaneously, acts to press the vanes 28 in the projecting direction thereof in a stable condition during the time groove 29 is in communication with the vane grooves 27. Meanwhile, the lubrication for the end plate 3, shaft sealing arrangement 46, etc. is effected through the vane grooves 27**.

In addition, in the cylinder 2, the refrigerant returning from the refrigeration cycle flows into the one chamber of the casing 9 from the suction pipe 7 as the rotor 5 rotates and further flows into the low-pressure spaces A and B inside the cylinder 2 from the inlet port 20 of the cylinder 2 for compression. Meanwhile, part of the refrigerant to be discharged from the discharge port 24 reversely flow into the compressing space D again without being discharged from the discharge port 24 through the escape groove 26 for re-compression to alleviate the pulsating pressure change in the discharge pressure.

Subsequently, upon shutting down of the compressor, the compression of the refrigerant is suspended, and the pressure supplied through the pressure passage 44 to the plunger chest 32 interrupted. Accordingly, the pressure inside the plunger chest 32 becomes smaller than the pressure inside the casing 9, whereby the pressure inside the valve chamber 31 equal to the pressure inside the casing 9 depresses the plunger 36 to cause the spherical valve 35 to cut off the communication between the second oil passage 33 and the third oil passage 34.

On the other hand, in the electromagnetic clutch 48, the lubricating oil leaking out of the shaft sealing arrangement 46 due to long-time use or the like is discharged through the cut groove 55 from the oil discharge passage 54 and flows to the open passage 57 along the guide plate 56 so as to be discharged through the opening 59 without being scattered therearound.

Accordingly, since the valve mechanism 30 is normally in its opened state during rotation of the compressor, the lubricating oil can be continuously fed by the valve mechanism 30 for pressing the vanes 28 without any changes in the amount of lubricating oil supplied to the vane grooves 27 due to the rotational speed of the rotor 5, and thus, the so-called "jumping" action of the vanes 28 which is caused during reciprocation of the vanes 28 is removed, and abnormal abrasion of the vanes 28 is prevented. Consequently, a rotary compressor, which has less high-pressure gas leakage and efficient compression can be advantageously provided. In addition, upon shutting down of the compressor, the valve mechanism 30 is quickly closed to cut off the supply of the lubricating oil to the vane grooves 27, so that the refrigerant gas and lubricating oil do not flow from the high-pressure side to the low-pressure side, whereby damage or deformation of the discharge valve 25 due to oil compression, etc. resulting from reverse rotation or during re-starting of the compressor is prevented.

Since the seal material 43 is provided on the plunger 36 constituting the valve mechanism 30 to provide proper friction between the plunger 36 and the plunger chest 32, pressure leakage from the plunger chest 32 to the valve chest 31 becomes less, whereby malfunctions due to pulsating pressure variations during rotation of the rotor 5 can be prevented. Also, when the pressure leakage is prevented by the seal material 43, and the difference in pressure between the pressure passage 44 and the discharge pressure is small, the spherical valve 35 is opened without fail to ensure a stable supply of the lubricating oil.

Moreover, since the discharge pressure is properly smoothed during rotation of the compressor through the escape groove 26, the pressure fed to the valve mechanism 30 through the pressure passage 44 is smoothed so as to hold the spherical valve 35 open in a more stable condition. When the compressor has been shut down, the compressed refrigerant located between the discharge port 24 and the top dead center position flows backward into the compression space D through the escape groove 26, and therefore, the "confining" phenomenon of the discharged refrigerant gas which occurs in the conventional device can be prevented. In addition to the stable supply of the lubricating oil to the vane grooves 27 as described earlier, the "jumping" phenomenon in which the vanes 28 overcome the oil pressure fed to the vane grooves 27 to temporarily space the distal ends of the vanes 28 from the inner wall face of the cylinder 2 due to the "confining" phenomenon is removed, and generation of vane noises, abnormal abrasions of the vanes 28, cylinder 2, end plates 3 and 4, etc. can be advantageously prevented.

The narrow passage 45 forming the contamination of the pressure passage 44 is effective for feeding the pulsating pressure, which is caused in accordance with the number of revolutions of the rotor 5 and the number of the vanes 28 used, in a smoothed state into the plunger chest 32, and for alleviating the reverse flow of the compressed gas inside the plunger chest 32, and therefore, during operation of the compressor, the valve mechanism 30 can be normally opened to a predetermined degree to effect a more stable supply of the lubricating oil.

Figure 3:
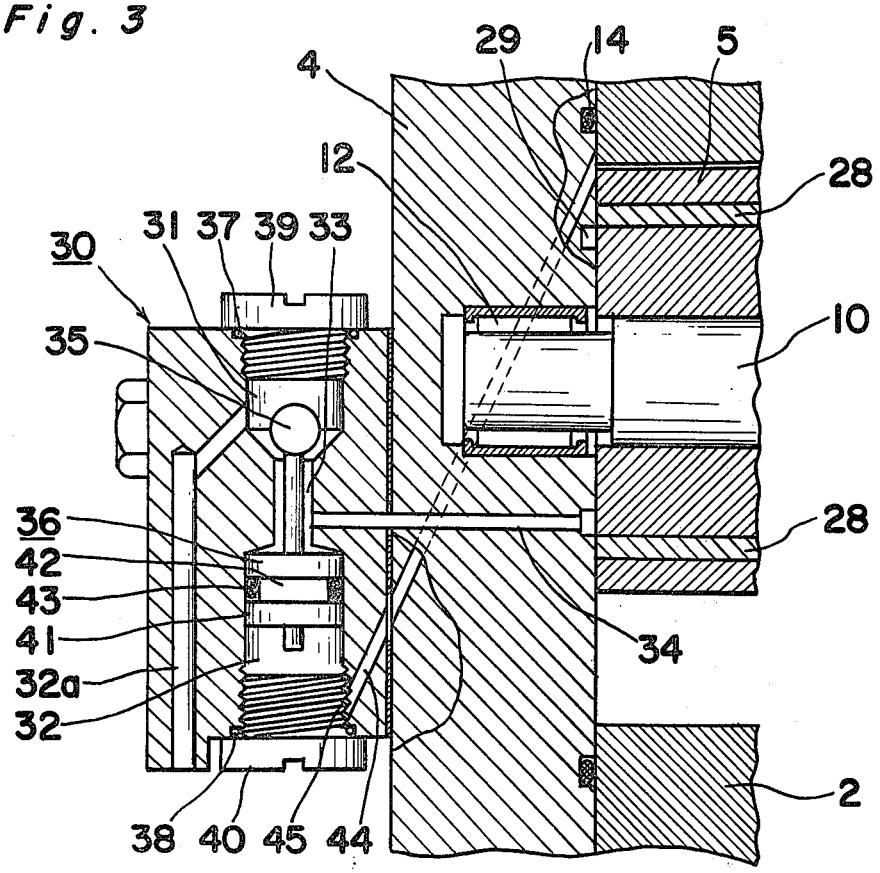
FIG. 3 is a cross sectional view showing on an enlarged scale, the construction of the valve mechanism employed in the rotary compressor of FIG. 1.
Figure 5:
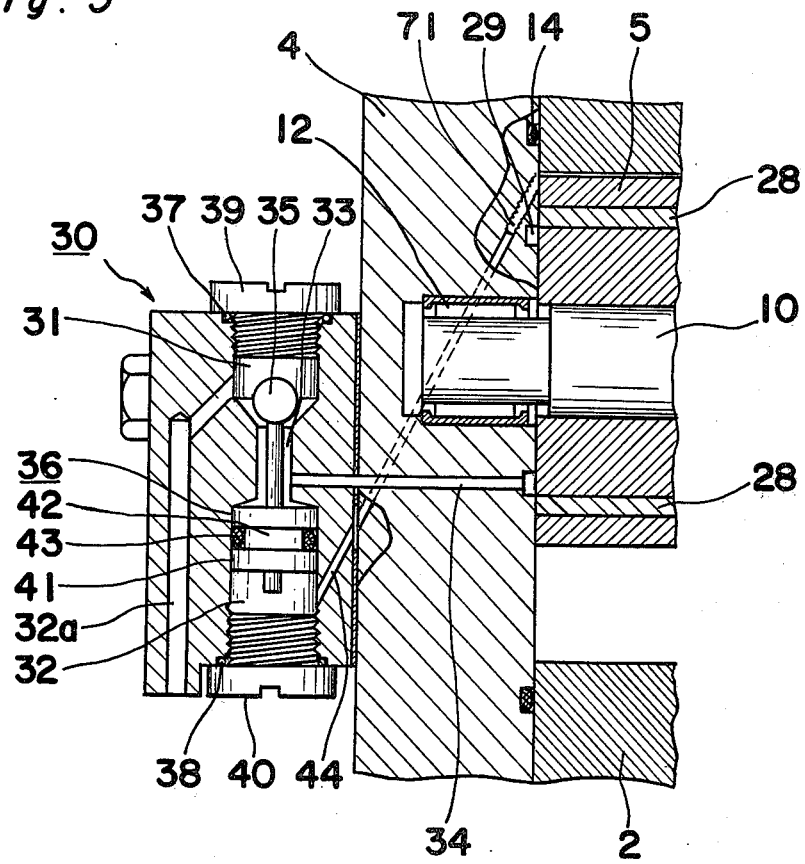
FIG. 5 is a view similar to FIG. 3, which particularly shows a modification thereof.
Figure 6:
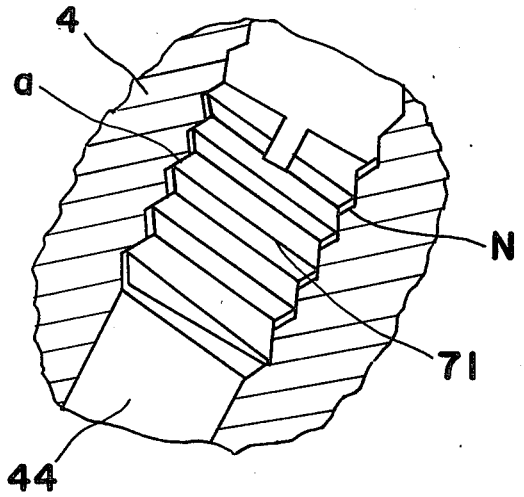
FIG. 6 is a fragmentary sectional view showing on a still more enlarged scale, a pressure passage employed in the arrangement of FIG. 5.

In the present embodiment, although the narrow passage 45 is formed by an extremely small clearance between the male threads of the bolt 40 and the female threads of the plunger chest 32 as shown in FIG. 3, similar functions and effects can be achieved even if the above arrangement is modified in such a manner that one end of the pressure passage 44 is opened into the plunger chest 32, and a throttle member 71 with spiral groove "a" formed in the outer periphery thereof is engaged with the threaded groove formed inside the pressure passage 44 to form a narrow passage N as shown in FIGS. 5 and 6.

As is clear from the foregoing description, in the vane type rotary compressor of the present invention, the lubricating oil is positively fed during rotation of the compressor by the valve mechanism in such a way as to prevent generation of the undesirable vane "jumping" phenomenon and vane noises, while the pulsating pressure caused in accordance with the number of the rotor revolutions and the number of the vanes employed is smoothed by the narrow passage provided in the pressure passage and the escape groove provided in the discharge port thereby to stably open the valve mechanism and to more stably feed the lubricating oil. Moreover, during shutting down of the compressor, the valve mechanism is closed to cut off the lubricating oil supply passage so as to prevent flowing of the refrigerant gas and lubricating oil from the high-pressure side to the low-pressure side, thus preventing the reverse rotation of the compressor, and damage and deformation of the discharge valve, resulting from the oil compression, etc. taking place during the reverse rotation or re-starting of the compressor.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A vane type rotary compressor which comprises: a cylinder having a cylindrical inner wall; a rotor rotatable within said cylindrical inner wall and having an axis of rotation eccentric to the axis of said cylinder for causing part of the said rotor to approach close to the cylindrical inner wall, said rotor having a plurality of radially extending vane grooves therein; vane members mounted in said rotor for being selectively projected from and retracted into said rotor and contacting said cylindrical inner wall at the radially outer ends thereof; said cylinder having a discharge opening therein; a pair of front and rear end plates on said cylinder and holding said rotor and vanes between the inner faces thereof for forming a suction space and a compression space within said cylinder between said vanes and said rotor and on which said rotor is rotatably supported; a casing on said cylinder and forming a space communicating with said discharge opening and a lubricating oil tank at the bottom portion of said casing; said compressor having a lubricating oil supply passage extending between said lubricating oil tank and the radially inner ends of said vane grooves for feeding lubricating oil to said vane grooves at the pressure of the gas within said casing which has been discharged from said compression space for pressing the vane members against the cylindrical inner wall of said cylinder; a plunger valve mechanism in said supply passage and having a valve for selective opening and closing of said lubricating oil passage, a plunger bore, a plunger reciprocally movable in said bore and having one end engaging said valve for opening and closing said valve, and a seal ring having a comparatively large frictional resistance and provided between said plunger and said plunger bore; and said compressor having a pressure passage communicating at one end with the compression chamber in said cylinder and at the other end to said bore on the other end of said plunger, and means in said pressure passage forming a narrow passage having a small cross sectional area as compared to the cross-sectional area of the remainder of said pressure passage, whereby pressure within said compression chamber, when applied to the other end of said plunger through said pressure passage, overcomes the discharge gas pressure within said casing so as to move said plunger and to open said valve for feeding the lubricating oil to said vane grooves under said discharge pressure.

2. A vane type rotary compressor as claimed in claim 1, wherein said narrow passage in said pressure passage is in the shape of a screw threaded groove.

3. A vane type rotary compressor as claimed in claim 1, said discharge opening is spaced in the direction of rotation of said rotor form the point at which said rotor most closely approaches the cylindrical inner wall of said cylinder, and further comprising relief groove means extending between the discharge opening and the portion of the cylindrical inner wall of said cylinder where the rotor most closely approaches said inner wall.

* * * * *